US006649910B2

(12) United States Patent
Sakairi

(10) Patent No.: US 6,649,910 B2
(45) Date of Patent: Nov. 18, 2003

(54) ANALYTICAL APPARATUS

(75) Inventor: Minoru Sakairi, Tokorozawa (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 10/232,718

(22) Filed: Sep. 3, 2002

(65) Prior Publication Data

US 2003/0020013 A1 Jan. 30, 2003

Related U.S. Application Data

(62) Division of application No. 09/293,886, filed on Apr. 19, 1999, now Pat. No. 6,483,108.

(30) Foreign Application Priority Data

Apr. 20, 1998 (JP) ..... 10-109016

(51) Int. Cl.[7] ..... H01J 49/10
(52) U.S. Cl. ..... 250/288
(58) Field of Search ..... 250/288, 287, 250/281, 282; 436/173

(56) References Cited

U.S. PATENT DOCUMENTS 4,580,440 A 4/1986 Reid et al.
4,718,268 A 1/1988 Reid et al.
5,128,269 A 7/1992 Oitate et al.
5,567,226 A * 10/1996 Lookman et al. ..... 95/3
5,726,447 A 3/1998 Aisawa et al.
6,140,639 A 10/2000 Gusev et al.
6,207,954 B1 3/2001 Andrien, Jr. et al.
6,222,185 B1 4/2001 Speakman et al.
6,232,599 B1 5/2001 Littlejohn
6,483,108 B1 * 11/2002 Sakairi ..... 250/288

OTHER PUBLICATIONS

Organic Mass Spectrometry, vol. 16, No. 6, 1981, "Atmospheric Pressure Chemical Ionization Negative Mass Spectra of the Dinitroluene Osomers", M. Asselin et al, pp. 275–278.

Tandem Mass Spectrometry, Ed F.W. McIafferty, John Wiley & Son's, Inc., 1983, "Trace Monitoring by Tandem Mass Spectromery", J.B. French et al, pp. 353–370.

* cited by examiner

*Primary Examiner*—Kiet T. Nguyen
(74) *Attorney, Agent, or Firm*—Mattingly, Stanger & Malur, P.C.

(57) ABSTRACT

For measuring dioxins and organic nitro compounds with high sensitivity while reducing complexity, efficiently ionize a sample using negative corona discharge; then, make use of a mass spectrometer to measure negatively charged ions produced.

5 Claims, 12 Drawing Sheets

RDX

PETN

ANALYTICAL APPARATUS

This is a divisional application of U.S. Ser. No. 09/293,886, filed Apr. 19, 1999. now U.S. Pat. No. 6,483,108.

BACKGROUND OF THE INVENTION

The present invention relates to analytical apparatus and, in more particular, to analytical apparatus adaptable for use in analyzing highly toxic dioxin generatable from incinerators or else while offering measurabilities for a variety of kinds of materials including vapors as vaporized from dangerous objects such as explosives typically including nitro compounds and also agricultural chemicals containing therein chlorine and/or phosphorus elements.

Prior known approaches to dioxin analysis include a method for employing gas chromatography mass spectrometers using a high-resolution mass spectrometer of the magnetic sector type. This method is typically designed including the steps of preparing a mixture of dioxins as concentrated or enriched through complicated pre-processing processes, introducing the dioxin mixture into a gas chromatograph for separation, and then irradiating it with electron beams providing positively charged ions for detection by the high-resolution magnetic mass spectrometer. An advantage of this approach lies in an ability to perform qualitative analysis of dioxins (specifying the exact kind of a dioxin of interest by rendering determinable how many coupled chlorine elements it has, or alternatively which one of dibenzo-para-dioxin backbone and dibenzofuran backbone it has) on the basis of ion's mass numbers detected, and also a capability to carry out a dioxin quantitative analysis based on ion intensities detected.

Another prior art technique for use in explosives detection instruments is shown in FIG. 18, which has been disclosed in "ORGANIC MASS SPECTROMETRY," Vol. 16, No. 6, 1981 at pp. 275–278. A method as taught thereby includes the steps of preparing dinitrobenzene dissolved in a chosen solvent such as methanol, letting it pass through a capillary 54 while simultaneously allowing a gas such as a nitrogen gas to flow in a pipe 55 coaxially provided to this capillary 54 for nebulization, and then generating a great amount of liquid drops 58. When this is done, the drops 58 generated are made finer by a heatup pipe 56 that is heated by its associated heater 57 while part of them becomes vaporized. Thereafter, the resultant vaporized molecules are guided into a negative corona discharge region which is associated with a corona discharging needle-like electrode 59 to thereby produce negatively charged ions or "anions" as to molecules of the sample under measurement, possibly due to electron addition effects and ion/molecule reaction activities.

The ions produced are then introduced for detection via a capillary into a mass analyzer unit 60, which may be a quadrupole mass spectrometer in high vacuum. With the prior art method also, it is possible, as in the method using the gas chromatograph mass spectrometer, to presume based on the mass numbers of detected ions what kinds of dangerous objects are present while at the same time enabling prediction of an amount of each dangerous object on the basis of ion intensity values detected.

The prior art dioxin analyzation using high-resolution magnetic-sector mass spectrometers has been designed to perform the intended analysis by positively ionizing dioxins through irradiation of electron beams thereonto. Unfortunately, this approach is encountered with several problems. One problem is that the detection sensitivity is relatively low due to the fact that the production efficiency of positive ions from dioxin molecules (ionization efficiency) stays lower than expected, which would in turn create the need for condensation or enrichment of dioxins at high degrees through complicated pre-processing processes prior to effectuation of the intended analyzation procedure. Another problem is that the need for such complicated and time-consuming preprocessing results in an increase in time duration while increasing costs therefor.

On the other hand the prior art explosives detection system is faced with a problem which follows. The expected detectability is hardly achievable in cases where samples of interest are less in amount. This can be said because in view of the fact that solid samples are dissolved in solvent such as methanol for introduction, the system is incapable of directly analyze vapors of such solid samples. Another reason considered is that nitro compounds in ion sources are inherently low in ionization efficiency resulting in difficulty of detection of such micro samples.

U.S. Pat. No. 4,580,440(Apr. 8, 1986) Method of Detecting a Contraband Substance U.S. Pat. No. 4,718,268(Jan. 12, 1988) Method and Apparatus for Detecting a Contraband Substance.

Other prior art technique is disclosed in Tandem Mass Spectrometry, F. W. McLafferty ed., John Wiley & Sons, Inc., p353–370, 1983 and "TRACE MONITORING BY TANDEM MASS SPECTROMETRY" J. B. French, W. R. Davidson, N. M.Reid, and J. A. Buckley Sciex Corporation. This method as taught thereby includes the steps of generating ions of M and/or (M-COCl) by using atmospheric pressure chemical ionization method with positive mode. However, this prior art is faced with a problem that ionization efficiency of dioxins and their related compounds is low.

Other prior art technique is disclosed in U.S. Pat. No. 4,580,440. This method as taught thereby includes steps of chemical concentration process, that is, collecting particulates, rapidly heating said collected particulates for achieving high sensitivity. However, said chemical concentration process is time-consuming both for one measurement and continuous measurement.

Other prior art technique is disclosed in U.S. Pat. No. 4,718,268. This method as taught thereby includes steps of chemical concentration process, that is, collecting particulates, rapidly heating said collected particulates for achieving high sensitivity. However, said chemical cocentration process is time-consuming both for one measurement and continuous measurement.

SUMMARY OF THE INVENTION

To avoid the problems associated with the prior art the present invention provides an improved analytical apparatus, which is arranged including a sample introduction unit for introducing a gaseous sample to be measured, a corona discharge unit for letting the introduced gas sample undergo corona discharge of the negative polarity, and a mass analyzer unit for mass analysis of ions as produced by the negative corona discharge.

More specifically, in accordance with the invention as disclosed and claimed herein, the apparatus utilizes the inherent nature of some dangerous objects (typically certain organic chlorinated chemical compounds including, but not limited thereto, dioxin and nitro compounds) which tend to become negatively charged ions in a way such that negative corona discharge is used for ionization to produce negative ions or "anions," which are then subject to measurement by use of a mass spectrometer. Such anions due to the negative corona discharge are much higher than positive ions in production efficiency. This allows the detection sensitivity to increase accordingly. This in turn enables elimination of any troublesome and time-consuming pre-processing procedures which otherwise have been strictly required in the prior art.

The sample introduction unit-includes a heatup module for use in heating a gas sample or samples up to predefined temperatures.

It should be noted that in order to efficiently perform generation of anions through negative corona discharge, it will be preferable that gas samples as introduced into the ion sources be set at high temperatures. Alternatively, it is recommendable to heat a corona discharging needle electrode used. Supposing that a gas sample is as high in temperature as about 100° C. or more, water content contained in such gas sample also is vaporized permitting efficient ionization due to corona discharge with increased stability. The higher the needle electrode temperature, the lower the corona discharge initiation voltage. This results in an increase in corona discharge current even with the corona discharge voltage unchanged. This in turn causes the ion production efficiency to increase. In view of this, it will be effective to provide the heater module for use in increasing the gas sample temperature.

This heater module is disposed in the upstream of a gas sample inlet pump which is for introduction of the gas sample. The module is constituted from an inner pipe and an outer pipe. The inner pipe permits free passage of the gas sample therein. The outer pipe is outside of the inner pipe. The module also includes a heater for heating the gas sample introduced, which heater is between the inner and outer pipes. Alternatively, the heater module is in front of the gas sample inlet pump. If this is the case, this module is designed to have a "double" structure consisting essentially of an inner pipe for gas sample flow and an outer pipe residing outside of the inner pipe with a gas sample heater disposed inside of the inner pipe.

Still alternatively, the heater module may be laid out between the gas sample inlet pump and the corona discharge unit while employing a heater disposed in contact with the gas sample introduced, thereby causing this heater to heat the gas sample.

Product ions obtained in the corona discharge unit are then guided via one or more capillaries provided between the corona discharge unit and the mass analyzer unit to enter the mass analyzer for mass analyzation.

The corona discharge unit may include a mechanism for controlling the corona discharger so that its inside pressure is at a desired level. To this end, the corona discharge unit has an exit port for use in letting any excess or surplus gases residing within the corona discharge region escape to the outside. This residual gas exhaust port may be provided with a dead weight or sinker member less in weight for achievement of automated control of exhaust amount of surplus gases. Optionally, a gas valve is added thereto.

Providing the corona discharge region heatup module for ensuring that a sample retained at high temperatures undergoes the corona discharge makes it possible to obtain preferable results stated above.

Also preferably, use of an ion trap mass spectrometer as the pass analyzer results in a significant increase in detection sensitivity. This sensitivity increase may avoid the need for complicated and time-consuming pre-processing using the gas chromatography.

While a corona discharge region is typically at atmospheric pressure, this region may be designed to have an air-proof structure providing a sealed environment inside thereof for increasing the density or concentration of molecules residing therein, which leads to an ability to increase the ion productivity in such corona discharge region.

This method disclosed in Tandem Mass Spectrometry, F. W. McLafferty, John Wiley & Sons, Inc., p353–370, 1983 includes the steps of generating ions of M and/or (M-COCl) by using atmospheric pressure chemical ionization method with positive mode. However, this prior art is faced with a problem that ionization efficiency of dioxins and their related compounds is low. Dioxins and their related compounds. By using atmospheric pressure chemical ionization method with negative ion mode, the ionization efficiency of those compounds became higher because of their high electron affinities.

This method disclosed in U.S. Pat. No. 4,580,440 includes steps of chemical concentration process, that is, collecting particulates, rapidly heating the collected particulates for achieving high sensitivity. However, the chemical concentration process is time-consuming both for one measurement and continuous measurement. By using physical concentration process based on an ion trap mass spectrometer, in which incident ions are trapped and concentrated with time, rapid measurement can be carried out.

The method disclosed in U.S. Pat. No. 4,718,268 includes steps of chemical concentration process, that is, collecting particulates, rapidly heating said collected particulates for achieving high sensitivity. However, the chemical cocentration process is time-consuming both for one measurement and continuous measurement. By using physical concentration process based on an ion trap mass spectrometer, in which incident ions are trapped and concentrated with time, rapid measurement can be carried out.

DETAILED EXPLANATION OF THE PREFERRED EMBODIMENTS

The analytical apparatus incorporating the principles of this invention is capable of extensively performing detection and quantitative analysis procedures of organic nitro compounds including those organic chemical compounds containing therein dioxins classified in organic chlorinated compounds (chlorine number-different dioxins, chlorine-contained dibenzo-para-dioxin, and organic compounds with dibenzofuran backbones) and also organic compounds having more than three nitro groups. Apparently, the present invention is not limited to detection of dioxins only, and also is applicable to agricultural chemicals analysis instruments or equipment for use in detecting agricultural chemicals containing chlorine and phosphorus elements.

The organic chlorinated compounds and organic nitro compounds discussed above tend to become negatively charged ions or "anions" in a way such that anions are readily producible in the presence of negative corona discharge applied thereto. In the past positive ions rather than anions are employed for such ionization stated supra. Use of positive ions results in a decrease in detection sensitivity, which requires that high-sensitivity mass analysis must come after enrichment of an object under measurement through the pre-processing using gas chromatography techniques resulting in an increase in process complexity and in time taken therefor.

In contrast thereto, the analytical apparatus of the invention is specifically arranged so that the negative corona discharge scheme is used to create anions, which are then subject to the intended measurement. Consequently, it becomes possible to achieve higher detection sensitivity than in the prior art positive ion-based measurement approaches. Especially, employing as the mass analyzer an ion trap mass spectrometer capable of retaining or storing ions in its interior may enable achievement of sample enrichment at higher degrees of concentration. Reliable analysis is thus expectable even in cases where objects to be measured, such as dioxins, are significantly less in concentration (typically, as low as 0.1 ppt or below). Optionally, quadrupole mass spectrometers or magnetic-sector mass spectrometers are employable.

<Embodiment 1>

Figure 1:
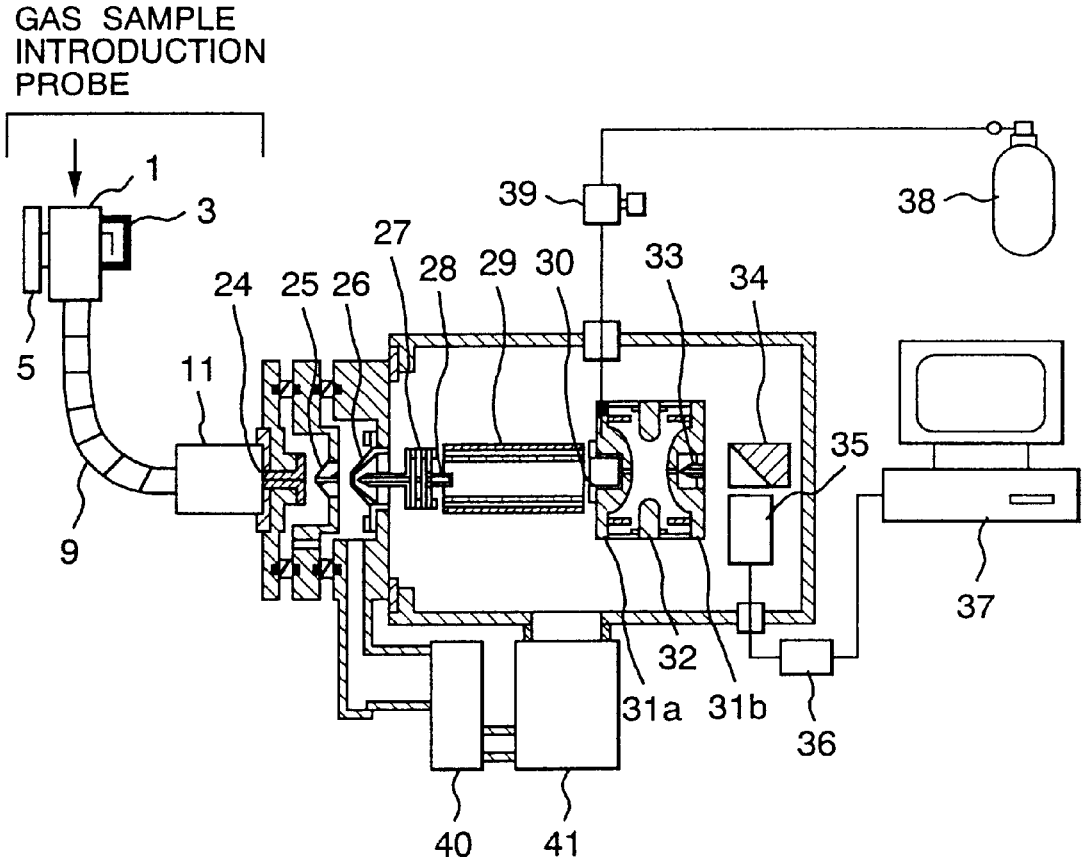
FIG. 1 is an apparatus configuration diagram explaining an embodiment 1 and embodiment 3 of the present invention.

Referring now to FIG. 1, there is shown a configuration of an analytical apparatus in accordance with a first embodiment of the present invention. This embodiment is illustratively arranged to heat specimen or samples at a gas sampling probe as provided in the upstream of a gas sample feed pump 11, although sample heatup prior to negative corona discharge is advantageous in actual implementation of the invention as will be discussed later in the description.

Figure 2:
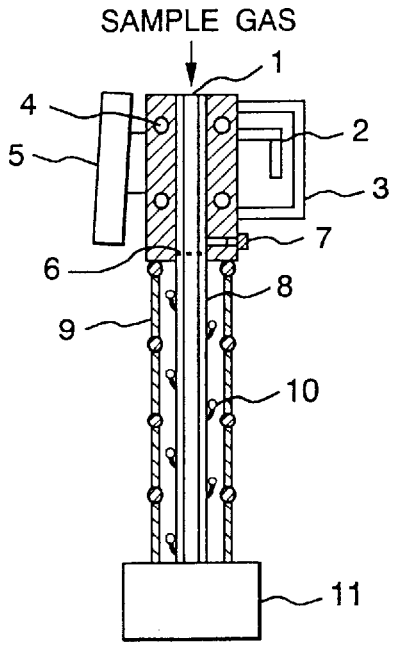
FIG. 2 a diagram for explanation of the embodiment 1 of this invention.
Figure 3:
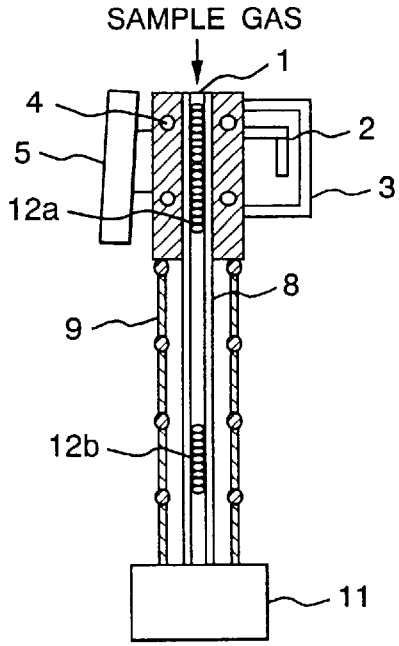
FIG. 3 a diagram for explanation of the embodiment 1 of the invention.

Two exemplary structures of the gas sampling probe are available, which are depicted in FIGS. 2 and 3 respectively. See first FIG. 2. A probe shown herein is structured including a gas sample feed pump 11 for introduction of a gaseous sample or samples via a gas intake port 1. This gas pump 11 is preferably a mechanical diaphragm vacuum pump which offers the gas sucking ability ranging from a few to several tens of litter per minute. The performance of this pump 11 might strongly depend upon the length of its associated gas pipe 8 which permits free passage of an gas sample of interest therein. The longer the pipe 8, the higher the pump performance required.

To eliminate unwanted absorption of a gas sample into inner walls of the gas inlet pipe 8, it is required that the pipe 8 be increased in temperature during introduction of such gas sample. To this end, as shown in FIG. 2, pipe 8 comes with a heater wire 10 as spirally wound around outer walls thereof to thereby heat gases flowing in pipe 8 up to relatively high temperatures. Typically, the temperature of pipe 8 is set at prespecified temperatures higher than room temperatures (falling within a range of from 10 to 30° C). Preferably the pipe temperature is set ranging from 100 to 200° C. In the illustrative embodiment the pipe 8 is made of a chosen resilient material such as for example Teflon. Provided around pipe 8 is a flexible pipe 9, preferably bellows pipe. The outer "shell" pipe 9 is for mechanical reinforcement of gas inlet pipe 8.

In case the gas feed pump 11 is used for introduction of one or more gas samples, a hand grip 3 is provided at the distal end of the gas sampling probe for facilitating operator's manual handling thereof. The hand grip 3 is illustratively disposed near or around a power switch 2 of the gas feed pump 11 as shown in FIG. 2. Also provided at the probe distal end is a heatup device 4 for eliminating absorption of gases thereat along with a filter 6 for use in preventing pipe 8 from sucking thereinto contaminant particles or dusts. A dust removal port 7, also called "trash outlet" in some cases, is preferably provided for removing contaminants trap-collected collected by filter 6 away from the probe.

When reduction to practice of the invention, the heatup device 5 may be an electrical heat-release light source that is constituted from either an infrared lamp or halogen lamp. Such lamp functions to heat solid samples for production of vapors to thereby facilitate detection of certain target materials, such as dioxins.

A probe structure shown in FIG. 3 is similar to that of FIG. 2 with the spiral heater wire 10 being replaced by a coil of multi-wound metal heater wire 12*a* as provided inside of the gas inlet pipe 8 for enabling direct heatup of gas samples flowing therein. Use of such "intratubal" coil heater 12*a* may reduce cost penalties otherwise occurring due to an extensive increase of the total length of spiral heater 10 with an increase in length of pipe 8 up to several meters or greater. In the example shown in FIG. 3, the probe comes with a plurality of spaced-apart coil heaters 12*a,* 12*b* all being "packed" within pipe 8. These heaters 12*a,* 12*b* may appropriately be increased in number if pipe 8 gets longer. In operation, the gas feed pump 11 is first activated initiating suction of a gas sample of interest; then, electrically energize coil heaters 12*a,* 12*b* to begin heating. After elapse of an appropriate time making heaters 12 hot sufficiently, measurement gets started.

With such sequence in operation, it is possible to eliminate or at least greatly suppress creation of a problem that low-temperature gas samples badly behave to absorb into inner walls of the gas inlet pipe 8. In addition, even in case the pipe 8 is made of a longer pipe, a correspondingly increased number of coil heaters 12 (12*a,* 12*b*) are laid out at predefined intervals along pipe 8, which minimizes heater cost increase. Another advantage lies in that due to rapid temperature increasability of such electrically powered heatup scheme, the coil heaters 12*a,* 12*b* promptly reach a target high temperature level with a shortened time period such as several seconds, which does no longer call for inevitability of all-time power-up of heaters 12 while simultaneously reducing operation maintenance costs. A further advantage is that disposing more than one coil heater 12 at a selected location within the pipe 8 in close proximity to the gas intake port 1 may force water-rich particles to be heated up for acceleration of vaporization of water, thus reducing risks of unwanted accommodation or "invasion" of such water-contained particles. As in the FIG. 2 structure, the probe of FIG. 3 also may come with the filter 6 and/or "trash" removal port 7.

After introduction via the gas sampling probe of FIG. 2 or FIG. 3, a gas sample of interest is guided to enter the analytical apparatus's corona discharge chamber (invisible in FIG. 1) for creation of negative corona discharge therein. This discharge results in production of negative ions or "anions," which are guided by capillaries 24–26 and electrostatic ion lens assembly 27 plus slit 28 as well as deflector 29 along with gate electrode 30 to finally reach a mass spectrometer of the ion trap type for effectuation of mass analysis processing. The ion-trap mass spectrometer is illustratively designed having an end-cap electrode 31*a* and ring electrode 32 or the like.

<Embodiment 2>

Figure 4:
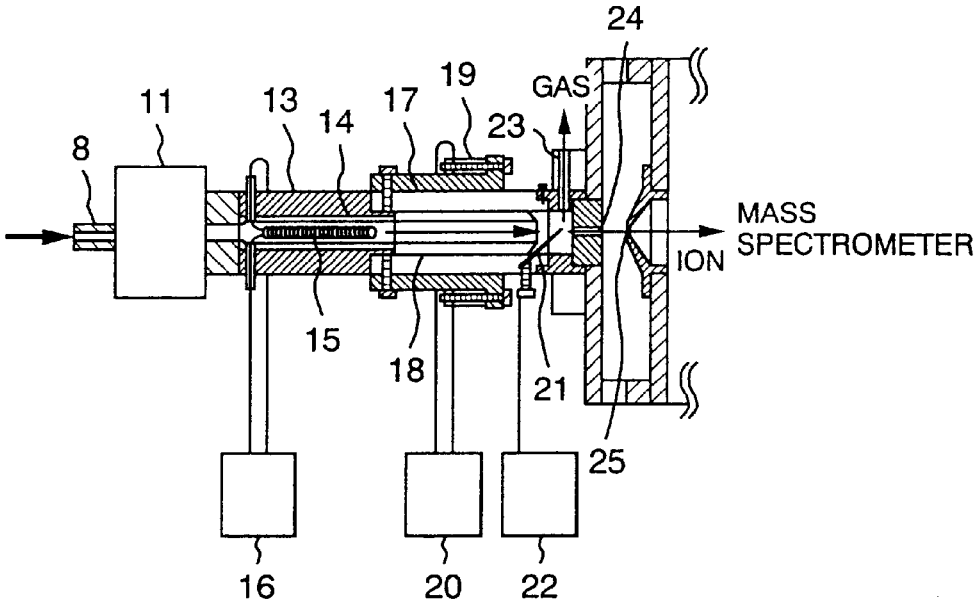
FIG. 4 an apparatus structure diagram explaining of an embodiment 2 of the invention.
Figure 5:
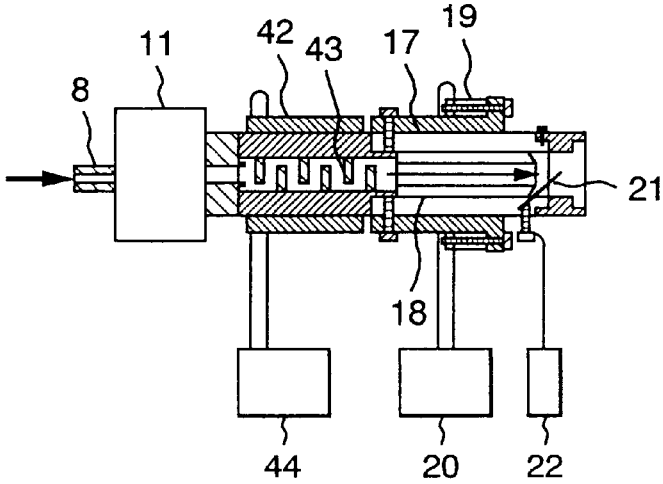
FIG. 5 an apparatus structure diagram for explanation of the embodiment 2 of the invention.

An explosives analytical apparatus in accordance with a second preferred embodiment of the invention is illustrated in FIGS. 4 through 9. The analytical apparatus is arranged so that the sample heatup module is in the downstream of the sample feed pump 11. A gas sample under measurement is introduced by means of the gas feed pump 11 from a gas inlet pipe 8 into a heating furnace 13. This heatup furnace 13 has a metallic block structure with a thermally insulative pipe 14 provided therein. Pipe 14 may be made of heat resistant materials--here, quartz. A coil-shaped metal-wire heater 15 is put in pipe 14 for heating a gas sample passing through this region up to high temperatures., The "intraductal" heater 15 may typically be a coil of metal wire—a nichrome wire, by way of example. The insulative pipe 14 has its diameter that is determinable depending on the amount of a gas flow required: in case gases are introduced at a rate of 2 litters per minute, pipe 14 measures 5 millimeters (mm) in diameter, or more or less. Pipe 14 is about 10 centimeters (cm) in length. Where appropriate, the coil heater 15 is replaceable with a collision plate heater 42 as shown in FIG. 5. This heater comes with an array of collision plates 43 which are alternately attached to the upper and lower inside walls of pipe 14 thereby defining a serpentine pattern of gas flow path therein. While these plates 43 forming such serpentine pathway are heated, a gas sample introduced imparts plates 43 sequentially so that it is heated up to relatively high temperatures upon every collision therewith.

Heating the sample in this way ensures that any externally attendant "invasion" contaminant particles are vaporized through heatup by the coil heater 15 or by cllision on heated collision plates 42. This makes it possible to avoid direct introduction of undesired particles and water content into the corona discharge region, which in turn enables corona discharge to remain stable in any events. The coil heater 15 is constantly kept at a desired temperature under well controlled electrical power feed from a heater power supply unit 16, letting the discharge region stay at a target temperature that falls within a predefined range of from 50 up to 400° C.

After having passed through the heatup furnace 13, the gas sample is guided entering a corona discharge chamber 17, in which the sample is ionized into anions. To guarantee that the gas sample introduced is efficiently supplied to the corona discharge region at the tip of a corona-discharge needle electrode 21, a guide path 18 is such that its distal end is at or near the needle electrode 21.

Figure 6:
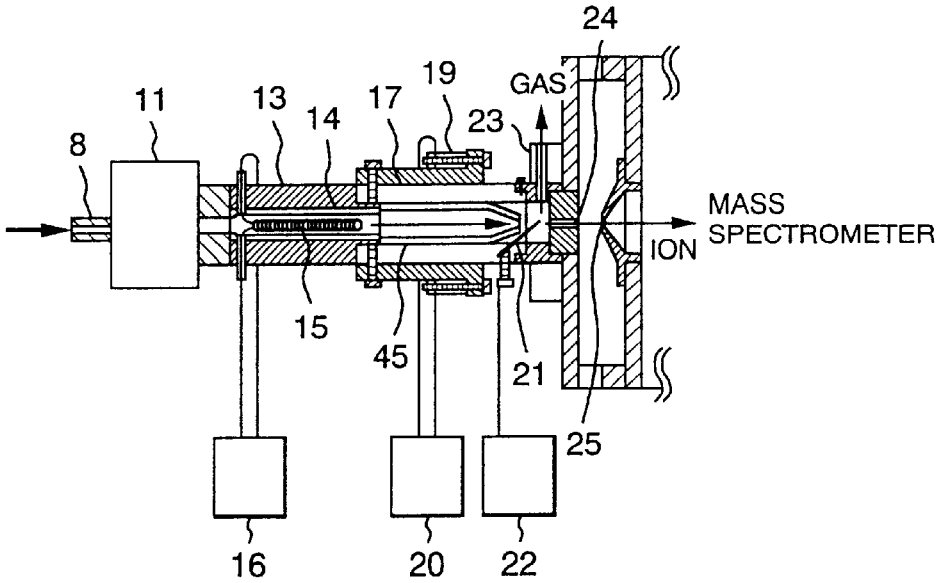
FIG. 6 an apparatus structure diagram for explanation of the embodiment 2 of the invention.

The guide path 18 of FIG. 4 may be replaced with a guide path 45 shown in FIG. 6 which is modified to be smaller in diameter of its distal end. Guide path 45 measures approximately 5 mm in inner diameter in its midway passage, and is about 1 mm in inner diameter at its distal end tapered or "nozzle." With such diameter value setting, it becomes possible to efficiently supply a gas sample of interest with increased reliability to the corona discharge region at the tip of the needle electrode 21. In this case the path 18 was 5 cm long. Path 18 in close proximity to needle electrode 21 was made of certain insulative materials including Teflon, glass-ceramics, ceramics, or else to thereby minimize electric field intensity reduction at the tip of needle electrode 21. This region can also be heated by a heater 19 as in the heatup furnace 13. This region is typically controlled to stay at specified temperatures of 50 to 300° C. while the heater is electrically fed by a power supply 20 operatively coupled thereto.

The corona discharge chamber 17 is associated with the corona discharge needle electrode 21, to which a high negative voltage (typically ranging between −2 to −5 kV) is applied by a corona discharge power supply 22. The needle electrode 21 is spaced apart by several millimeters from its opposing electrode 17.

A gas sample of interest as introduced from the corona discharger 17 via the first capillary 24 is sent forth through the second capillary 25 toward the mass spectrometer, whereas surplus gases other than ions and molecules are removed away from a waste gas exhaust port 23.

Figure 8:
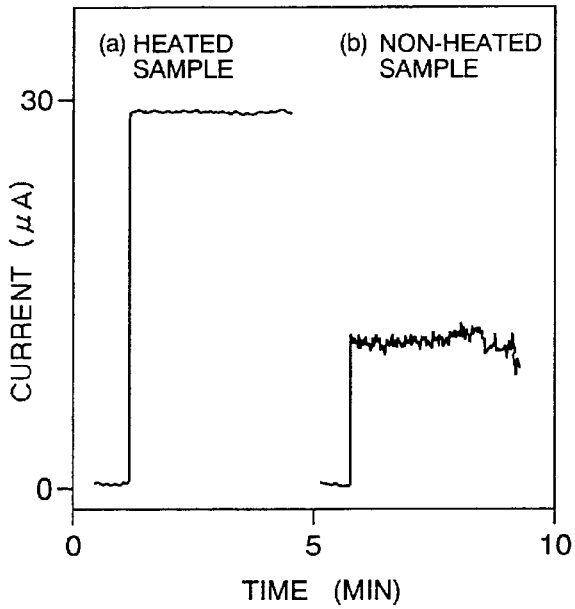
FIG. 8 is a diagram showing heatup effects.

See FIG. 8, which is a graph showing a current measurement value change with time as obtained by corona discharge activities in case a gas sample within the heatup furnace 13 is thermostatted at a high temperature (here, 150° C.) along with those current values as measured in case the gas undergoes no heatup processes and is set at a low temperature (30° C.). Chlorobenzene was used as a sample here. This sample was vaporized at room temperatures to release its vapors, which are then sucked by pump 11.

As apparent from viewing the graph of FIG. 8, the current flowing in the heated sample, adhered with label "a" in FIG. 8, was approximately 2.5 times greater in value than that of the heatup-free sample added with label "b" herein even where the corona discharging voltage is kept constant at −2.5 kV, for example. In addition, the resultant current stability of the former case is significantly greater than that of the latter case. When the gas sample's temperature is as high as 100° C. or more, any water content possibly contained in the sample is well removed away through vaporization resulting in ionization due to corona discharge being carried out efficiently with enhanced stability. The heated sample up to high temperatures also behaves to indirectly or secondarily heat the needle electrode 21, resulting in an increase in temperature thereof. The higher the needle temperature, the lower the corona discharge startup voltage. This leads to obtainability of large corona discharge current even when the discharge voltage stays at the same potential, which in turn permits the ion productivity to likewise increase.

It has been affirmed that in addition to the temperature, the pressure in a region in which ions are producible by corona discharge is also an important factor. Most atmospheric pressure ion sources utilizing corona discharge schemes are typically provided with a port 23 for use in removing surplus gases away from such ion sources, which gases are hardly flown into from a capillary for accommodation of ions in the vacuum of the mass spectrometer. For this purpose, the surplus gas exhaust port 23 is opened at all times during operation of the illustrative analytical apparatus, letting the corona discharge region be at atmospheric pressure (760 Torr, or more or less). However, in practical implementation, an optimal pressure value of such corona discharge region was higher than the atmospheric pressure of 760 Torr. This is due to the fact that the ionization efficiency was much controlled depending on the concentration of molecules residing in the corona discharge region, rather than on the atmospheric pressure: the higher the molecule concentration, the higher the ionization efficiency.

Figure 7A:
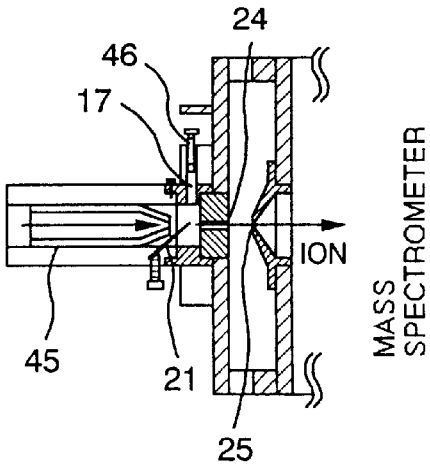
FIGS. 7*a* and 7*b* diagrams explaining the embodiment 2 of the invention.
Figure 7B:
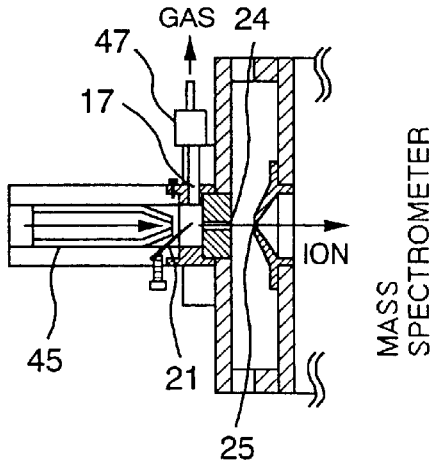

Conversely, if the pressure near or around the capillary 25 (0.2 to 0.5 mm in diameter) for accommodation of product ions in the vacuum of the mass spectrometer becomes too high, then those molecules flowing through this capillary 25 into the high-vacuum mass spectrometer is excessively increased in number, making it difficult to retain the mass analysis unit at a high vacuum required. To avoid this, the surplus gas exhaust port 23 shown in FIG. 4 for example is blocked permitting continuous introduction of a sample gas using the gas feed pump 11, which in turn increases the internal pressure of the corona discharger 17. However, use of such arrangement alone can still suffer from risks of excessive increase of inflow amount of gases from the ion intake capillary 24. In view of this, as shown in FIG. 7A, a piece of dead weight 46 is arranged at surplus gas exhaust port 23 for reduction of conductance concerned. When the internal pressure of corona charger 17 becomes too high, such weight 46 attempts to float allowing surplus gases to escape from port 23 to the outside. Establishment of a well-balanced relation of the amount of gases flowing into discharger 17 versus the weight of such "gas release adjuster" member 46 makes it possible to control the discharger 17 so that it is at a desired pressure level in any events. Optionally, an alternative arrangement shown in FIG. 7B is employable, wherein the gas release adjustment weight 46 is replaced with a gas release valve of similar functionality. This valve 47 is provided at surplus gas exhaust port 23. Valve 47 is driven to open and close periodically during operation of gas feed pump 11 for control of the inside pressure of corona discharger 17.

Figure 9:
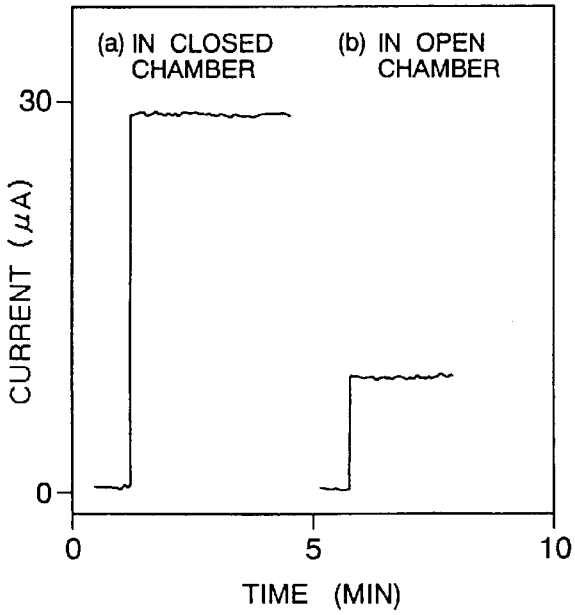
FIG. 9 is a diagram showing affection of pressure.

Some current measurements are presented in a graph of FIG. 9. These current values were measured as a change with time when the corona discharge region is increased in pressure in case the gas release adjuster weight 46 is put at the surplus gas exhaust port 23. A current change pattern measured when adjuster 46 is in the blocked state is presented at left-hand part "a" of the FIG. 9 graph, whist a corresponding current pattern obtained when both adjuster 46 and port 23 are opened letting the corona discharge region be at nearly atmospheric pressure is indicated at the right-hand part "b" in FIG. 9. A sample used was made of chlorobenzene. This sample was vaporized at room temperatures to provide vapors, which are then sucked by pump 11 for measurement of a peak value of resultant current for comparison. It is apparent from viewing FIG. 9 that the current in the former case (a) is three times greater in intensity than that in the latter case (b). This encourages experts to believe that increasing the internal pressure of corona discharger 17 is effectively contributory to an increase in detection sensitivity.

<Embodiment 3>

While a variety of types of mass spectrometers are employable for analyzation of product ions in the corona discharge chamber 17, an ion-trap mass spectrometer of the ion trapping type was used in this embodiment, which may be arranged as shown in FIG. 1. The same goes with those cases of using quadrupole mass spectrometers or magnetic-sector mass spectrometers.

Upon production of ions in the corona discharge chamber 17 (not shown in FIG. 1), these ions are guided to pass through first to third capillaries 24–26 of a differential evacuation section as heated by the heater 19. The first capillary 24 measures 0.3 mm in diameter, and about 20 mm in length. The second capillary 25 is 0.2 mm in diameter and 0.5 mm long. The third one 26 is 0.3 mm in diameter and 0.5 mm long. While ions penetrate capillaries 24–26, cluster-ion dissociation takes place due to heatup and/or cllision with residual neutral molecules, resulting in creation of ions of the molecules of a specimen per se. A voltage is applied between capillaries 24 and 25 and also between capillaries 25 and 26 for improvement of ion transmission efficiency while at the same time permitting effectuation of cluster dissociation due to such cllision of ions with residual molecules.

The differential evacuation unit is evacuated by a rough vacuum pump 40, which is typically a rotary pump, scroll pump, mechanical booster pump, or else. A turbo molecular pump is useable for evacuation of this region if needed. A pressure difference between capillaries 25, 26 was set at 0.1 to 10 Torr. Product ions travel to pass through the third capillary 26, and then are "focused" by an electrostatic lens 27. This lens is preferably an einzel lens with three electrodes.

After having passed through the slit 28, ions are deflected by the deflector 29 to penetrate the gate electrode 30 entering an ion-trap mass spectrometer, which includes a pair of dome-shaped endcap electrodes 31*a*, 31*b* along with a ring electrode 32. Slit 28 is for limiting "stereoangle" of a jet containing therein neutral particles as inflowed from a skimmer(s) to thereby eliminate unintentional introduction of unnecessary particles into the mass spectrometer used. Deflector 29 is provided for inhibition of direct introduction of neutral particles into the spectrometer interior via the endcap electrode 31*a*'s capillary after having passed through the skimmer. In the illustrative embodiment the deflector 29 is preferably of dual cylinder type including an inner cylinder and outer cylinder with multiple openings or apertures provided in the inner cylinder. This deflector offers ion deflectability by use of those electric field components as leaked from such cylinder apertures. Gate electrode 30 functions to prevent ions from attempting to enter inside of the spectrometer from the outside at a step of removing away those ions trapped within the ion trap mass analyzer toward the outside of the system concerned.

After having introduced into this ion trap mass spectrometer, ions collide with a helium (He) gas supplied to the interior space of the spectrometer so that the orbital shrinks. Thereafter, resultant ions are externally removed away from the system by scanning of a high-frequency electric field being applied to the ring electrode 32, and are then guided to pass through an extraction lens 33 for detection by an ion detector. The He gas or the like may be supplied from a gas supply unit 38 via a regulator 39. The gas supply 38 may be a gas cylinder or stock bomb. As the ion trap mass spectrometer inherently offers an ion trapping and storage ability, even where a sample being detected is less in concentration, the intended detectability is obtainable by lengthening a time for ion storage. Thus, even where the sample concentration is low as in dioxin analysis, it is possible to achieve high-degree condensation of ions at the ion trap mass spectrometer, which in turn simplify the procedure for pre-processing of such sample. For detection of those ions taken out of the mass spectrometer, these are converted by a conversion dynode 34 into electrons, which are detected by a scintillation counter 35. The resulting electrical signal is passed to an amplifier 38, which provides an amplified signal. This signal is then sent to a data processing device 37.

The electrostatic lens 27, slit 28, deflector 29, gate electrode 30, ion-trap mass spectrometer and ion detector are laid out inside of a chamber, the interior of which is evacuated by means of a turbo pump 41 for removal by suction of molecules involved. Note here that the turbo molecule pump 41 calls for an auxiliary pump on its back pressure side. Such pump and the roughing evacuation pump 40 for use at the differential evacuation unit may be formed of a single common pump. In this embodiment a scroll pump was used for the differential evacuation unit, which pump offers gas evacuation capacity of approximately 900 litters per minute. For chamber evacuation a turbo pump with its capacity of about 200 litters per minute was used while letting the scroll pump have co-functionality of the auxiliary pump of the turbo pump. With such a system arrangement, it becomes possible to much reduce complexity of gas exhaust system of atmospheric pressure ionization mass analytical equipment. Additionally, the deflector 26 may be eliminated in cases where ion deflection is not essential to the equipment.

Figure 10:
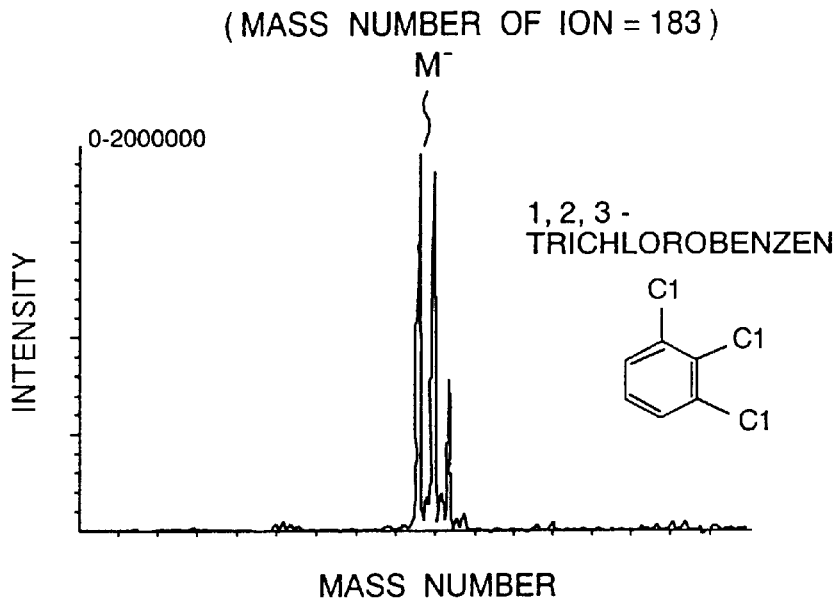
FIG. 10 is a diagram showing one example of resultant mass spectrum.
Figure 11:
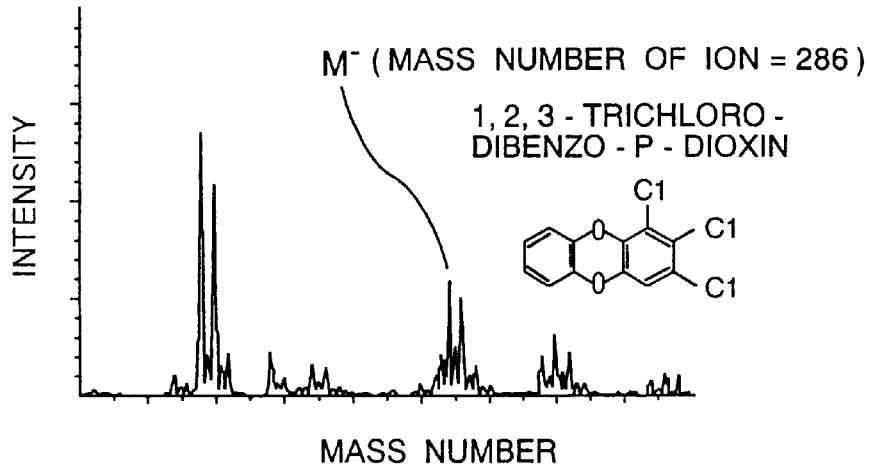
FIG. 11 is a diagram showing an example of resultant mass spectra.

Ordinarily the data processing device 37 is designed to visually indicate several information concerned, including a relation of a mass number-to-charge ratio and ion intensity (mass spectrum), a change with time of ion intensity regarding certain mass number/charge ratio (mass chromatogram), and others. Exemplary measurement results of mass spectrum are shown in FIGS. 10–11, wherein FIG. 10 is for 1,2,3-trichlorobenzene whereas FIG. 11 is for 1,2,3-trichlorodibenzo-p-dioxin (one of dioxins). In either case molecular ions $M^{-}$ with electrons added thereto are observed clearly, which in turn demonstrates that the invention is effective to measure such materials. Note that in the graphs of FIGS. 10–11, molecular structures of 1,2,3-trichlorobenzene and 1,2,3-trichlorodibenzo-p-dioxin are illustrated for reference. Those chemicals having the backbone of dibenzo-p-dioxin with lack of a single oxygen atom are called dibenzofuran, which might exhibit severe toxicity as in dibenzo-p-dioxin. This material also was measured with high sensitivity by the analytical apparatus embodying the invention.

Figure 19:
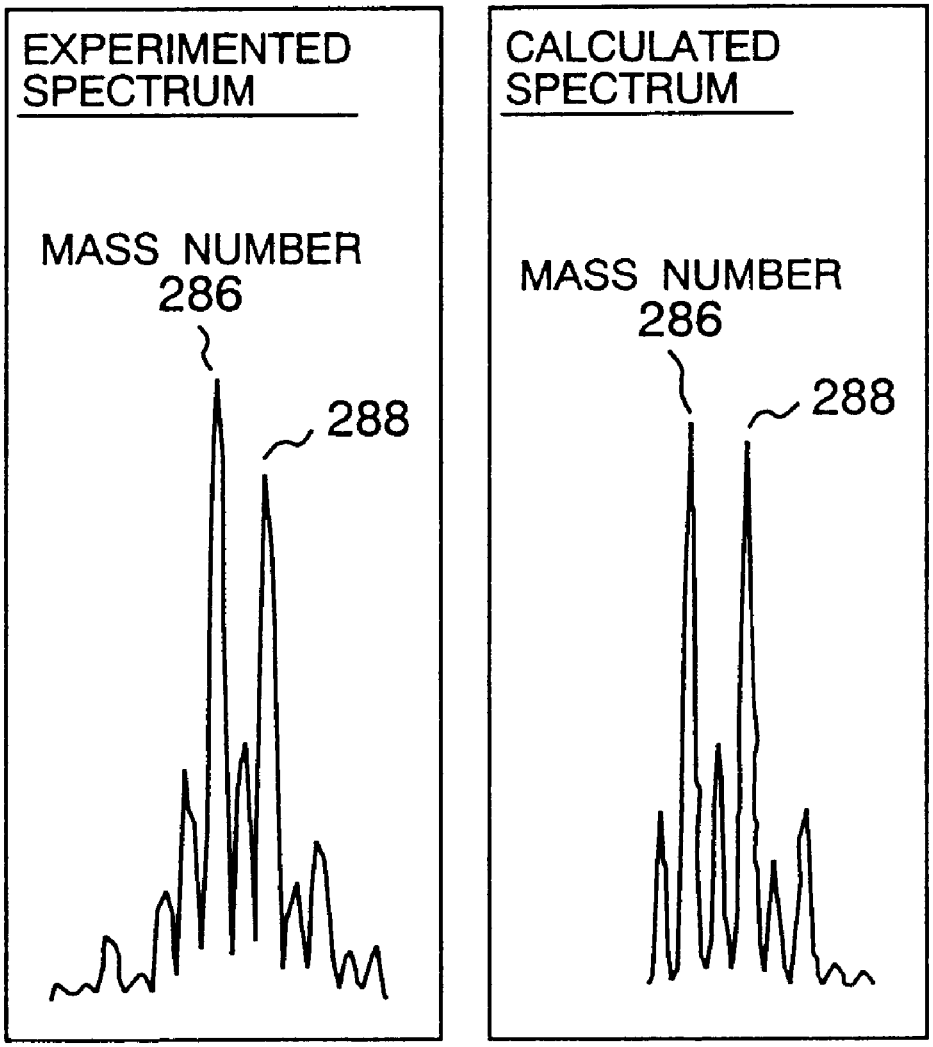
FIG. 19 is a diagram showing a molecular region of 1,2,3-trichloro-para-bendioxin.

A detail of the molecular ion region of 1,2,3-trichlorodibenzo-p-dioxin under observation is depicted in FIG. 19, which presents two separate graphs showing measurement values through experimentation. As seen from the left-hand graph in FIG. 19, a complicated pattern of peaks are observable due to presence of the chlorine's two possible stable isotopes (one is 34.9688527 in mass number and is 75.77% in relative abundance whereas the other is 36.965903 and 24.23%). Comparing the measurement results of FIG. 19 to mathematical calculation results revealed the fact that these peaks are explainable as superimposition of ions ($(M-H)^{-}$) generated by dehydrogenation reaction in addition to anions ($M^{-}$) produced due to electron attachment which may be the principal reaction in negative corona discharge activities. Adversely, employing this feature may increase certainty as to nature identification through observation of an intensity ratio of plural peaks—for example, intense peaks 286 and 288 in FIG. 19.

Figure 12:
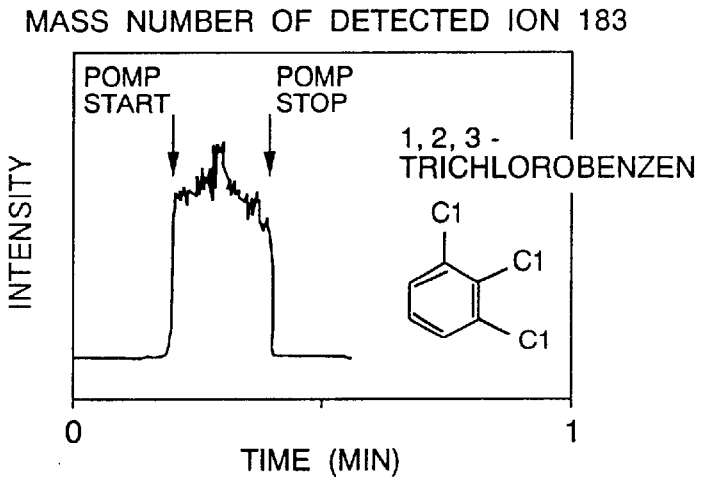
FIG. 12 is a diagram showing one exemplary ion intensity detected.

In this way, as specific organic materials having backbones of dibenzo-p-dioxin and dibenzofuran with halogen added thereto tend to become negative ions or anions in the presence of negative corona discharge with increased ion production efficiency, these may be measured with high sensitivity by the analytical equipment embodying the invention. A mass chromatograph is shown in FIG. 12, which was obtained with 1,2,3-trichlorobenzene used as a specimen. Upon introducing of a gas sample by the gas feed pump 11, target components are detected so that a signal increases. When termination, such signal disappears. Utilizing this phenomenon enables accomplishment of online monitoring.

Figure 13A:
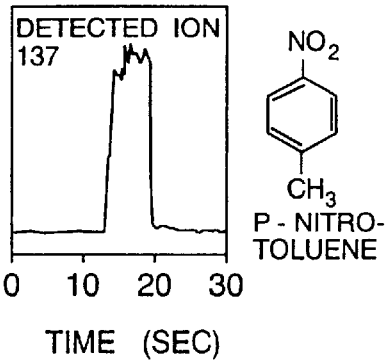
FIGS. 13*a* and 13*b* are diagrams showing an exemplary ion intensity detected.
Figure 13B:
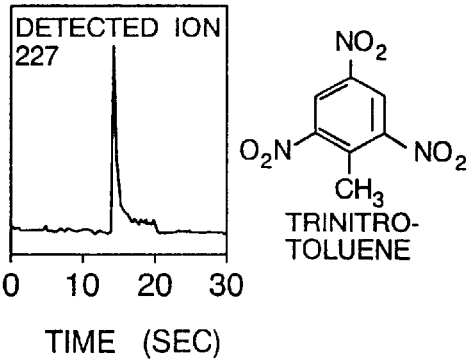
Figure 14A:
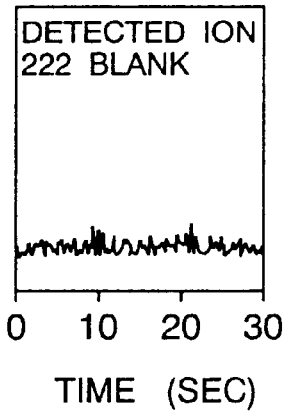
FIGS. 14*a* and 14*b* and 14*c* are diagrams showing an exemplary ion intensity detected.
Figure 14B:
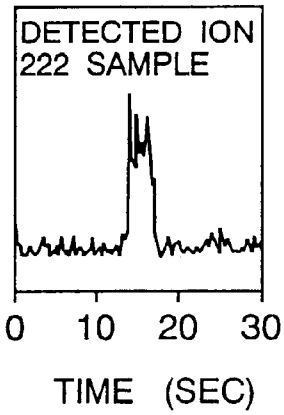
Figure 14C:
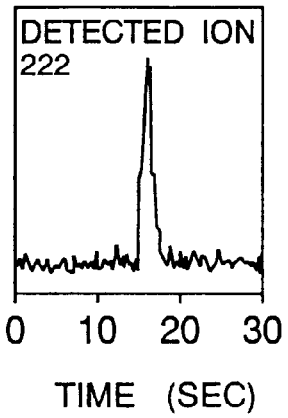
Figure 14C:
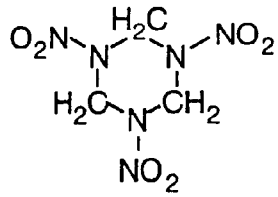
Figure 14C:
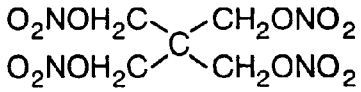

The same is applicable to the case of nitro compounds, which calls for careful handling in the course of detecting dangerous objects including explosives. It was possible to measure specific nitro compounds with high detection sensitivity and increased reliability, which have more than three nitro groups and are low in vapor pressure, such as mononitrotoluene and trinitrotoluene as shown in FIG. 13 or alternatively cyclotrimethylenetrinitramine (RDX) and pentaerythritol tetranitrate (PETN) in FIG. 14. This advantage comes because such nitro compounds are high in anion productivity due to negative corona discharge as in the organic chlorine compounds discussed previously.

Nitro compounds tend to get higher in anion productivity with an increase in number of nitro groups therein. FIGS. 12 and 13 indicate mass chromatography measurement results, in which vapors of solid-state specimen at room temperatures (20–30° C.) are sucked by the gas pump 11 and then ionized by negative corona discharge letting product ions be fed to the mass spectrometer for detection. Obviously the principles of the invention are applicable to measurement of other nitro compounds, such as those with a single nitro group (the mono-nitrobenzene shown in FIG. 13, for example) or two-nitro group ones. In such cases also, the intended measurement is attainable with increased detectability and reliability.

Figure 15:
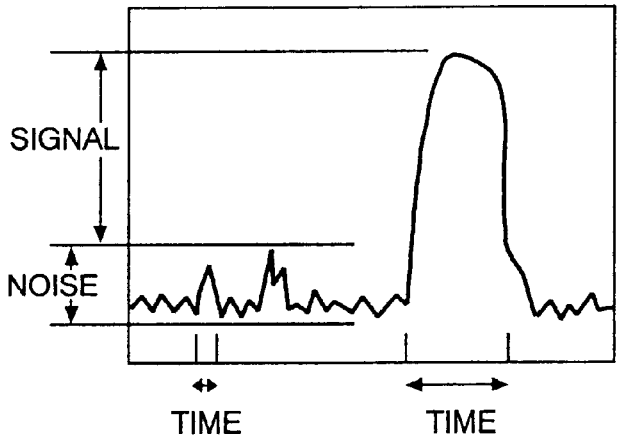
FIG. 15 is a diagram indicating a relation of noises and signals.
Figure 16:
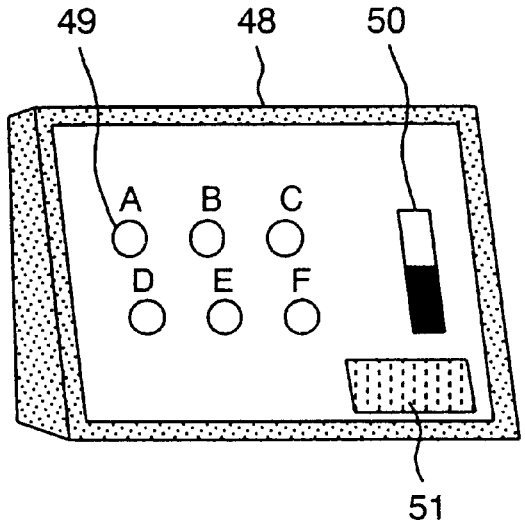
FIG. 16 is a diagram showing an example of an indicator.

Note that the data processor 37 is modifiable to display, as final indication, further simplified information rather than the mass spectrum and mass chromatogram. In the case of explosives detection equipment, it is designed to display a mere indication as to whether the target nitro compound(s) is/are detected successfully. One example-is shown in FIG. 15. Suppose that noises of certain level are found in a detected pattern of target ions of the specified kind. Imagine that a signal is detected with its intensity level greater than the noise level. If this is the case, the analytical equipment is operable to determine that detection of such ions was in success. To distinguish it from mere spike noises this equipment is designed employing an algorithm which specifies whether a noise level change continues in a preselected time period or longer, and if so then regards it as the signal. Addition of such algorithm makes it possible to reduce risks of erroneous operations. An indicator 48 shown in FIG. 16 is preferably useable for final data visualization. Indicator 48 has on its front panel several indicator lamps 49 along with an analog bar-chart display 50 and alarm 51. Indicator lamps 49 are provided in a way corresponding in number to specified kinds of materials (A-F) of interest to be detected. Indicator 48 operates under control of the algorithm to turn on and off or "blink" a lamp labeled A when such material A was detected. In such event the bar-indicator 50 varies its bar in length to show the concentration value of material A detected. The bar indicator 50 may be replaced by a more simple, binary indicator that informs whether the amount is greater or less.

<Embodiment 4>

Figure 17:
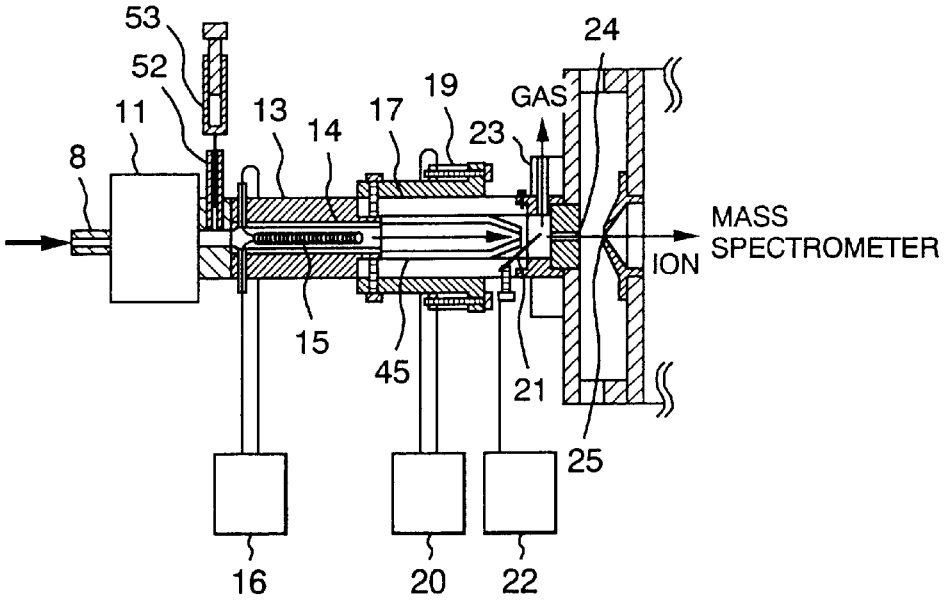
FIG. 17 is a diagram showing an example of apparatus structure.
Figure 18:
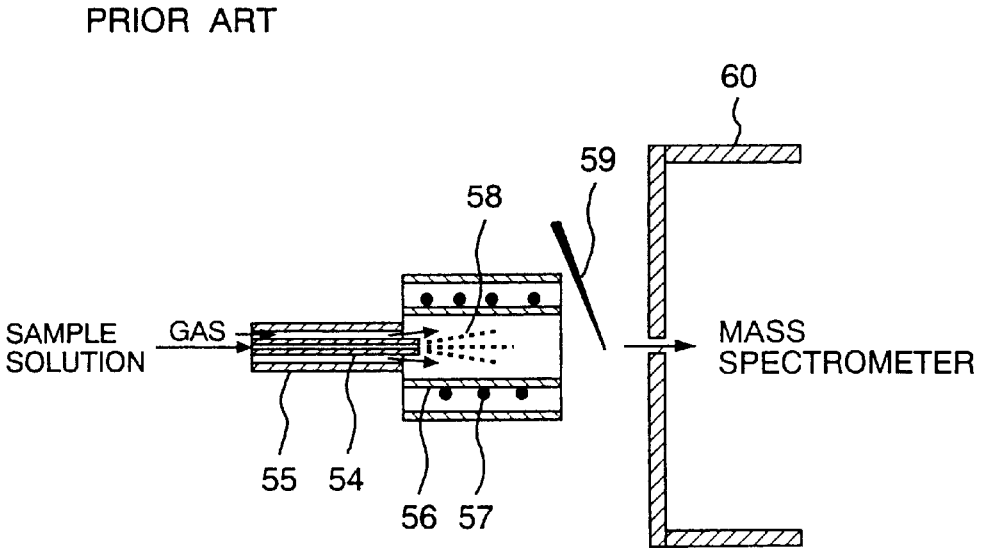
FIG. 18 is a diagram showing an example of prior art apparatus.

Although a respective one of the embodiments above is arranged so that the gas feed pump 11 is used to introduce gas samples continuously without interruptions, the pump 11 may be replaced with a syringe pump 53 as shown in FIG. 17. This syringe is operable to introduce a gas sample or samples via its associated gas inlet port 52 to the mass spectrometer in an offline fashion.

The analytical equipment incorporating the principles of the invention is also applicable to liquid samples (some dioxins are possibly dissolved in organic solvent) in the alternative of gaseous ones. If this is the case, a solvent sample with target material dissolved therein is nebulized by means of gas-use nebulizers or thermal nebulizers to provide a gas, which is then introduced into the heatup furnace 13 shown in FIG. 2 for analyzation. In this case no extra gas feed pumps are needed because high-speed jets are generatable from a nebulizer used.

<Embodiment 5 >

The analytical apparatus of this invention can be connected directly to an incinerators so as to continuously monitor exhaust gas components. Measuring quantities of dioxins and their precursors of chloro-benzenes, chlorophenols, hydrocarbons from an incinerator and controlling combustion condition of the incinerator on the basis of the result become possible to reduce the quantity of dioxins.

Figure 20:
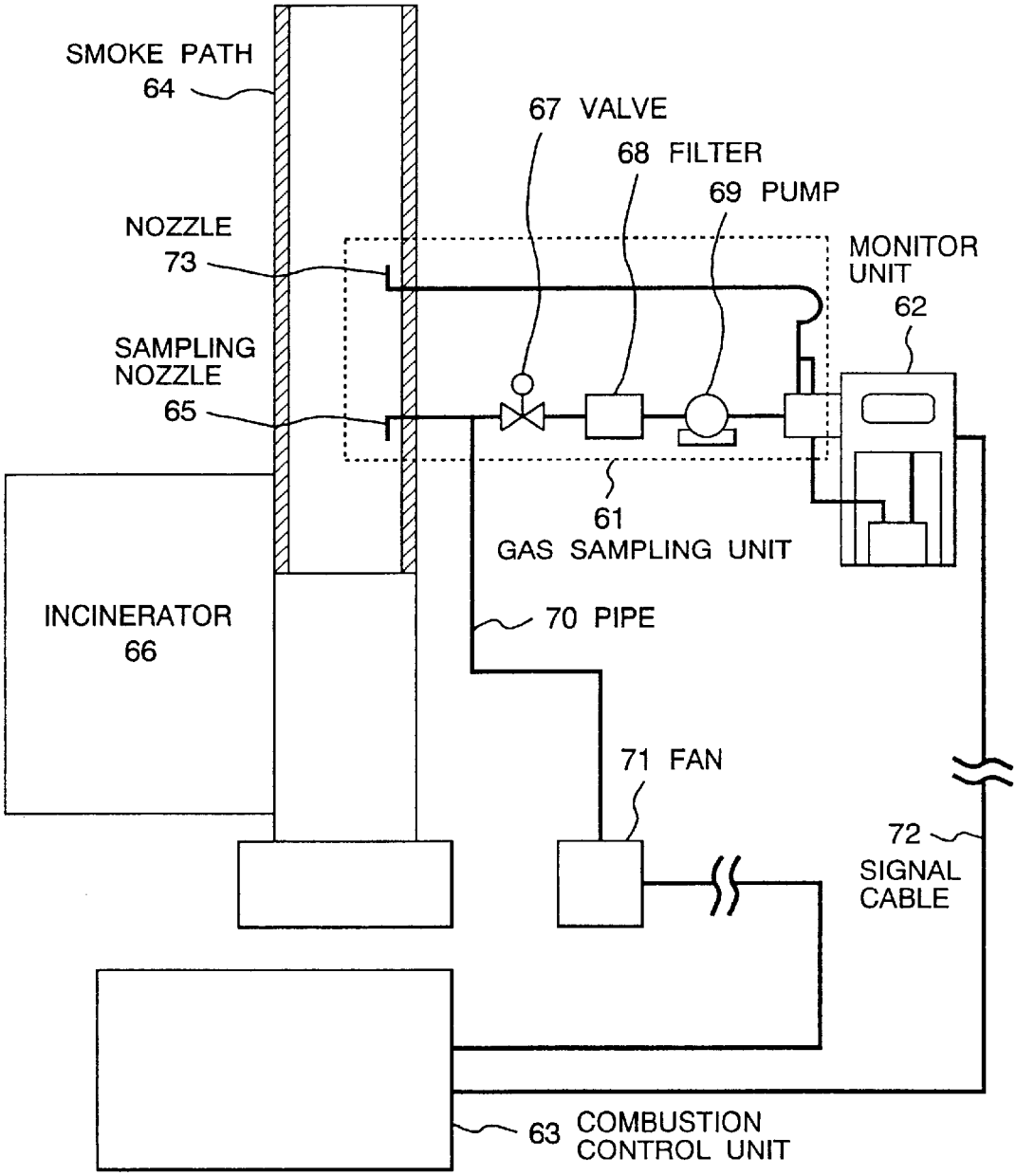
FIG. 20 is a diagram of the monitoring system of the invention.

FIG. 20 shows the constitution of the monitoring system based on this invention. The system consists of a gas sampling unit 61 having a valve 67, filter 68 and pump 69 for sampling gases from a smoke path or flue 64 of the incinerators, a monitor unit 62 for measuring exhaust gas components, a combustion control unit 63 to control combustion condition from the measurement results and so on. The monitor unit 62 corresponds to the analytical apparatus of this invention.

The gas sampling unit 61 has a function of carrying exhaust gas components to the monitor unit without loss by adsorption, condensation and so on of exhaust gas components and with a constant flow rate by using a sampling nozzle 65, the valve 67, filter 68 and pump 69. The whole gas sampling unit 61 is heated to from 100° C. to 300° C. The exhaust gas components are continuously detected by mass-analyzing the ions selectively and efficiently generated by a mass spectrometer The exhaust gas from the monitor unit 62 is introduced to the smoke path 64 through the nozzle 73 again.

From the relation (calibration curve) between quantity and ion substances can be determined. The data obtained is output to a CRT and a printer by necessity and besides, restored with concentration and other parameters of components. Also, it is sent to a combustion control unit 63 as the data for combustion control of an incinerator through a signal cable 72.Chloro-benzene molecules as a precursor of dioxin capture an electron and generate ions of $M^-$. Chlorophenol molecules give ions of $(M-H)^-$. Dioxin molecules give $(M-Cl)^-$, (M−cl+0) and so on besides ions of $M^-$. These characteristic peaks lead to measurement with high selectivity and sensitivity.

The correlation between dioxin and chloro-benzene (or chloro-phenol is used to estimate dioxin concentration from the concentration of chloro-benzene or chloro-phenol It is desirable that the correlation of every incinerator with different types is obtained to estimate dioxin concentration with higher accuracy.

An ion trap mass spectrometer is used to achieve higher selectivity by using MS/MS method. By using this method, molecular ions are dissociated into fragment ions as a result of collision of the excited molecular ions with neutral molecules(He) in mass analysis region. One or more chlorine atoms are removed in the case of organic chlorine compounds with MS/MS method, For example, negative ions of $(M-H)^-$ are produced by using by the corona discharge with negative ionization mode in the case of 2, 4 dichloro-phenol. By MS/MS method one chlorine atoms removed from the ions to produce characteristic fragment ions. This process can obtain very high selectivity. From the peak intensity, the quantity of dichloro-phenol in exhaust gas can be estimated. It is sufficient to repeat this measurement process in the case that there is a plural object components. The process of removal of Cl or COCl is observed in the case of the dioxin and the like.

Especially, the process of removal of COCl is observed only for the dioxin and the like. To the contrary, this process observation proves the existence of dioxin. For stable compounds which are hard to produce fragment ions by MS/MS method, it is preferable that contaminants are dissociated by MS/MS method.

In the case mentioned above, the atmospheric pressure chemical ionization method with a negative ionization mode is mainly used, The various components are included in exhaust gas.

The atmospheric pressuze chemical ionization method with positive ionization mode is possible for hydrocarbons like aromatic compounds and organic compounds with few chlorine.For example, the ions of M+ for benzene, monochloro-benzene and so on are generates by the atmospheric pressure chemical ionization method with positive ionization made. Accordingly, the quantity of information is increased for sample gas components by measuring positive and negative ionization modes alternately in actual measurement.

The measurement of dioxin and its related compounds inexhaust gas from an incinerator was described. Measurement can be carried out with the same apparatus and method for exhaust gas in metal refine process. Also, a direct grasp becomes possible, how much dioxin and the like is included in exhaust gas such as an incinerator by the monitoring system.

This leads to real-time monitoring in different sampling points in an incinerator and then optimization of combustion process to reduce production of dioxin and the like.

If dioxins with high concentration are detected by this monitoring system, this system alarms for the control of the combustion condition of the incinerator. Further, the gas sampling unit 61 which has the smoke path 64 for taking the gas sample from the combustion chamber and/or the end of the gas intake port 1. The sample gas is analyzed by the analysis apparatus using the negative corona discharge to detect the dioxins and the like. The analysis apparatus is preferably disposed within distance of 20 m from a sampling point.

The temperature of the incinerator is regulated in accordance with the quantity of the dioxins so as to reduce the dioxins in the exhaust gas.

When the quantity of the dioxin is large, the temperature of the incinerator is controlled at a range of temperature from 800° C. to 120° C.

The sample gas is back to the smoke path 64 from the analytical apparatus or the combustion chamber of the incinerator, if possible. As the temperature of the exhaust gas from the combustion chamber is high at the end of smoke path 64, the exhaust gas is discharged into the atmosphere after reducing its temperature by passing through the filter 68. The gas sampling port is positioned at the atmosphere side of the filter 68 as shown in the present embodiment.

What is claimed is:

1. An incinerator system comprising:

an incinerator having a smoke path;

a monitor unit for continuously monitoring exhaust gas components in said smoke path;

a gas sampling unit for sampling the exhaust gas components from said smoke path and for carrying the exhaust gas components to said monitor unit with a constant flow rate by using a sampling nozzle disposed in said smoke path, a valve, a filter and a pump; and a combustion control unit to control combustion condition of said incinerator by the measurement results by said monitor unit;

wherein said monitor unit includes:

a gas inlet pipe for introducing the exhaust gas components;

a corona discharge chamber having a needle electrode;

a gas feed pump for introducing the exhaust gas components to said corona discharge chamber;

a corona discharge power supply for supplying a negative voltage to said needle electrode;

a surplus gas exhaust port for releasing surplus gases residing within said corona discharge chamber;

a mass spectrometer for mass-analyzing ions created by corona discharge; and means for adjusting a pressure in said corona discharge chamber to a desired level.

2. The incinerator system according to claim 1, wherein said desired level of pressure in said corona discharge chamber is higher than atmospheric pressure.

3. The incinerator system according to claim 1, wherein said surplus gas exhaust port is in said corona discharge chamber.

4. The incinerator system according to claim 1, wherein external release of surplus gases residing within said corona discharge chamber is controlled with a gas release valve provided at said surplus gas exhaust port.

5. The incinerator system according to claim 1, wherein a temperature of said incinerator is regulated in accordance with the quantity of dioxin so as to reduce dioxin in the exhaust gas from said incinerator.

* * * * *